US007628115B2

(12) United States Patent
Thompson

(10) Patent No.: US 7,628,115 B2
(45) Date of Patent: Dec. 8, 2009

(54) MECHANISM FOR COLLAPSIBLE CATAMARAN

(75) Inventor: Philip Merrick Thompson, 23 Lindsay Ave Volentine, Newcastle, N. S. W (AU) 2280

(73) Assignee: Philip Merrick Thompson, Newcastle (AU)

( * ) Notice: Subject to any disclaimer, the term of this patent is extended or adjusted under 35 U.S.C. 154(b) by 333 days.

(21) Appl. No.: 11/442,345

(22) Filed: May 30, 2006

(65) Prior Publication Data

US 2008/0196648 A1 Aug. 21, 2008

(30) Foreign Application Priority Data

May 31, 2005 (AU) ..... 2005902763

(51) Int. Cl.
*B63B 1/14* (2006.01)

(52) U.S. Cl. ..... 114/61.18

(58) Field of Classification Search ..... 114/61.1, 114/61.18, 61.15, 61.16, 61.17
See application file for complete search history.

(56) References Cited

U.S. PATENT DOCUMENTS 6,178,913 B1 * 1/2001 Brignolio ..... 114/61.18
6,298,802 B1 * 10/2001 Brignolio ..... 114/61.18
6,397,769 B1 * 6/2002 Bullmer ..... 114/61.18
6,640,737 B2 * 11/2003 Chacon ..... 114/61.18

* cited by examiner

*Primary Examiner*—Lars A Olson

(57) ABSTRACT

A method of folding the bridge structure between a catamaran's hulls so that the bridge structure can retract and expand laterally on the water. The structure is made from easy to manufacture panels and provides increased amenity for the crew of the catamaran as well as increased interior room compared with other folding methods for catamarans.

4 Claims, 5 Drawing Sheets

Figure 1:
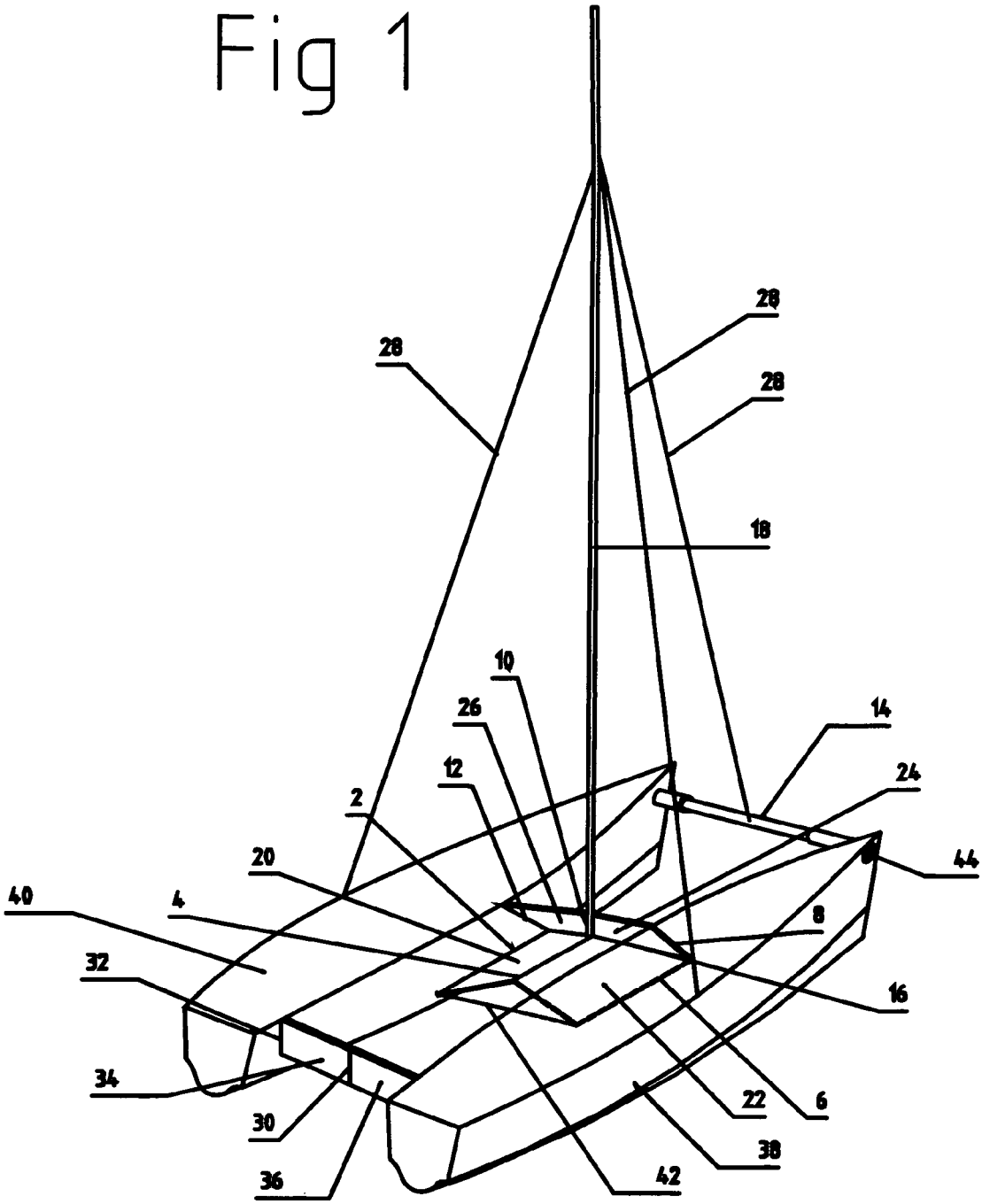

18
44
4
14
22
20
6
2
42

18
4
30
24
10
36
44
38
22
6
8

MECHANISM FOR COLLAPSIBLE CATAMARAN

FIELD OF THE INVENTION

This invention relates to catamaran sail and power craft specifically referring to a method of reducing their beam for trailing and mooring.

BACKGROUND DESCRIPTION OF THE INVENTION

Catamaran sailboats have developed over the past 60 years to now be a well-engineered and accepted choice of vessel for a large section of the public. Their increased use in the fields of public transport, tourism operations and private use, along with many design and construction improvements has led to a change in the attitudes of the maritime community to catamaran vessels. They are now well accepted by many in the maritime community.

One large factor still providing resistance to the greater acceptance of catamaran vessels is their great width. Catamarans have a beam measurement that is typically 60- to 70 percent of their length in width so many cruising catamarans may be as much as 24 feet wide. In many localities the extra area taken up by the greater width of a catamaran produces problems in their storage. Many marinas charge extra fees to berth a catamaran and some marinas are unable to accept catamarans due to the position of mooring poles and such. When catamarans need to be taken out of the water many slipways and travel lifts are unable to accept them due to the catamaran's great width. Catamarans are usually light and easily moved but their great width makes them difficult to remove from the water on normal equipment.

Catamarans have much potential as trailerable boats. Their light weight allows them to be towed behind a larger range of cars than ballasted boats. Their divided accommodations provide for the individual spaces necessary for a family cruiser. Their large cockpit along with the low level of heel makes using a catamaran an easy and fun experience. The problem until now has been how to reduce the catamaran's beam when required.

Many attempts have been made to overcome the problems of beam reduction and many patents issued on the topic. None of these has resulted in the trailerable catamaran becoming common due to a deficiency in the usefulness of each separate concept.

Many inventors have tried to modify the typical structures found on catamarans. Derek Kelsall uses telescopic beams in his approach in his Xcat designs. There is much that is correct with this approach in that the catamaran can be folded on the water and that the hulls do not rotate as extension or retraction occurs. The problems with this approach are that the mast cannot be in the raised position when undergoing extension or retraction and that large sleeves in the interior of the hulls compromise the amenity of the hull's interior. Extension and retraction is dependent on the beams sliding well inside their outer telescopic members and sleeves. This is very hard to achieve in practice as dirt and scratches increase the friction of the sliding parts. On top of this a small gap must be left between each telescopic section which increases the slack in the beam. In practice it has been found to be very hard to reduce beam with this arrangement and most catamarans of this type are rarely retracted once launched.

Builders using this design have reported much hardship in getting the sliding beams to slide during expansion and retraction. One of the great problems that the designer has been unable to rectify is how to produce a well engineered and easy to make sliding beam system. The many efforts of builders have gone into solving this problem but even with many minds working on the problem these boats have not been seen expanding and retracting as theory says they should.

One problem with the theory is scaling up the loads that occur in models. Although the telescopic approach can be made to work on small boats the physical fact that loads increase much faster than size, (the so called square/cube rule in which things get weaker as they get bigger, witness a small boat being able to easily lie on a rough surface whereas a vast ship would break its back) means that many theories that work well in small sizes do not work when applied to catamarans over model size.

Indeed one of the loads that had to be coped with during the development of the full size prototype on which this patent is based is the tendency of catamaran hulls to rotate, deck inwards, as the folding process occurs. Development was needed to overcome this in the prototype and the beams used in the prototype also had to move easily under heavy loads. To this end the telescopic beam used for carrying the mast and deck loads was ruled out and pivoting panel sets were used Another problem with this telescopic beam approach is its structural integrity. Telescopic beams are not especially strong as they rely on each part being "buried" in its neighbour to pass along the forces they are designed to resist. If the amount of bury is increased the beam of the catamaran must be reduced which is undesirable, or the number of telescopic elements has to be increased which increases the complexity, weight and slack in the beam. A catamaran puts massive forces on its beams and this method is destined to be used in only a reduced number of small catamarans.

Another approach to the folding problem is to use a box-like framework which is disassembled when beam is reduced. This approach can produce a more structurally sound catamaran than the telescopic beam catamaran but has many problems. One of the main problems with this approach is that reducing the beam of the catamaran is a long and laborious process and cannot be done in a reasonable timeframe. On top of this bolt together assemblies are not highly suitable for the cyclic loads found in catamaran structures.

To get around the problems with the above methods catamaran designer Richard Woods has designed the "Wizard". This catamaran has a central pod that contains the accommodations, crew cockpit and rigging attachments. The two hulls fold down underneath the pod to fit on a trailer. It has the benefit of being structurally sound, with its use of well proven hinges and deep beam bury, and of being quick to fold. Its major drawback is that it requires a special trailer and cannot be folded in the water. Additionally the hulls are not useful as storage or accommodation on the trailer as the hulls are rotated through 90 degrees when folded. The fact that it does work well is testament to the concept of using rotating structural members rather than sliding beams. However like Kelsall's catamarans the limitations placed on use, a special trailer is needed for folding and deep launching ramps needed for trailering, means that these boats are rarely built.

This method of using rotating structural members is the basis for the most successful folding multihull—a trimaran. Farrier (U.S. Pat. No. 3,937,166) uses hinges and crossbeams to rotate the outer hulls of a trimaran in a very strong and effective way. His method allows users to fold or retract the hulls underway and without special trailer arrangements. Best of all it is a very quick and easy method to use.

Farrier's method has proven very successful and over 2000 of his designs have been built around the world. However his method is only suitable for trimarans and not for catamarans as catamarans have very different structural requirements and loading conditions. Trimarans do not have the same advantages as catamarans in terms of accommodation and interior and exterior utility. Trimarans are rarely built as cruising boats these days due to these limitations.

Farrier's trimarans are also structurally robust. They highlight the efficacy of using rotating members such as struts to achieve a strong folding system. Of all the folding systems patented for reducing beam in a multihulled boat Farrier's is by far the best but its many advantages only apply to the trimaran configuration.

The use of rotating members in catamarans is not new. Many unpatented designs have used rotating panels such as one from the board of Roger Simpson. However the rotating panels proved unable to properly cope with the loads found on a catamaran out on the water and these boats were rarely used and often found with their beams bolted permanently to guard against structural failure. The vertically hinged panels were easy to build and could rotate easily without load but under loading they showed many signs of strain.

The use of rotating panels with hinges for catamarans was patented by many including Pelly (U.S. Pat. No. 5,522,339). This method uses thick flat panels with over centre clips as the structural members. The thick flat panels are aligned in the vertical plane to cope with the mast compression loads and other structural loads and have a hinge at the hulls inside edge and another at the centreline of the boat where the panels join onto their complimentary member. Flat panels are also used to from the cockpit floor. While this is a reasonable technique in some ways it does not cater for the extreme loads found in a catamaran's beam.

One difficult problem is that of keeping the two panels that make up the mast beam straight. The underside of the beam is under tension and this will stay straight naturally as the mast compression load is applied. The top of the beam however is under extreme compression forces, when mast loading is applied, and putting a hinge in a beam and then trying to keep it straight under compression is very difficult. To remedy this Pelly uses large pivoting compartments that take up valuable interior space when folded.

Putting hinges in the middle of a simply supported beam reduces the ability of that beam to handle load. The highest loads in a simply supported beam are found in the middle of the beam. Putting hinges in this area will not produce a robust structure.

Furthermore the mast compression loading is only one of the loads found on a catamaran. Many of the twisting and torque loads found when in rough water put huge forces on any crossbeam arrangement. Normal catamaran beams are not thin sandwich structures capable of taking loads only in the vertical plane but are box-beams capable of handling torsional loads and horizontal plane loads as well. A catamaran undergoes severe torsional loading when a gust hits the sails. The sidestays that hold up the mast are usually led back behind the centre of gravity of the hulls. This creates a torque as the hull is lifted so that the bow of the lifted hull drops compared to the stern of the same hull. Some large catamarans with low torsional stiffness resort to running anti-twist lines from the mast and cleated up forward (an example of this is an aluminum beam catamaran such as Tennant's Bladerunner). This loads the beam and mast more highly and is not a reliable method for beginner and social boat users.

Pelly's patent uses rotating members that have their axis of rotation in the vertical plane. This is typical of the vast majority of catamaran designs that use rotating panels to cope with the mast loading. The use of vertically rotating panels is useful for some areas of a catamarans structure but what Pelly and others including Francke (see below) do not recognise are the huge forces that try to rotate the hulls of a catamaran so that both hulls want to rotate their decks inwards as the boat is retracted. The loads on the folding mechanism are huge at point when the hinge and panel system becomes weaker due to their being in an angled orientation rather than in a straight orientation as when sailing.

What is needed is a way of coping with the twisting loads that a folding system will be unable to properly cope with during the retraction and expansion process. To this end a simple sliding tube or tubes arranged to keep the hulls in the vertical plane will stress the folding mechanism much less during retraction and expansion. As a benefit the tube or tubes can be arranged to provide a method of expansion.

U.S. Pat. No. 6,546,885 (Francke) discloses a variable width catamaran having tandem pairs of scissor-like folding mechanisms located between the hulls. Francke's patent is designed to allow retraction to occur with the mast still standing. Francke's patent uses very high quality and expensive components to cater for the highly stressed simply supported beams and connective structures. Additionally the mechanism intrudes into the accommodation along a considerable length of the hulls.

Francke's patent has problems that are shown in the changes to his prototype after its initial testing. Much credit must go to Francke for developing his prototype to full size but at full size complications due to unrecognized loads can prove detrimental. Although it had been folded with the mast on the centreline in a quiet waterway Francke's boat was quickly modified to a twin mast configuration that located each mast in each hull. As Francke's scissor like arrangement folds, the mast moves forward relative to the ends of the beams. This stresses the hinges and is probably one of the reasons that Francke has removed the single mast mounted on the centreline and put one mast in each hull. Obviously there are problems with a vertically rotating mast support system as the mast loading puts greater and greater side loads on the hinges in the structure as the catamaran folds.

A system where the mast supporting system consists of panels that rotated so that the mast was not displaced horizontally produces no extra strain on the hinges as the mast support panel set rotates. Panels could move about an axis that is substantially horizontal and substantially parallel to the centreline of each hull.

By using panels that rotate about a horizontal axis the mast will move in a vertical direction when expansion or retraction occurs. This will allow the mast step to be raised up when folded so that the mast step can easily be reached by sailors when rigging the boat. It also allows a higher deck to be designed so that interior volume is increased inside the hulls.

Another improvement is that the hinge point for a horizontally pivoting mast panel set needs to be straight and so the insides of each hull have to be straight along the hinges length. This increases the interior room of each hull and makes each hull easier to build from easy to obtain sheet material like plywood or foam sandwich.

The main problem with a horizontally pivoting mast panel arrangement is providing strength to resist the huge mast compression forces when each panel arrangement needs three hinge points to be able to fold up during the hull's retraction. The panels should be as thin as possible to allow the hulls to be as wide as possible. Trailering restrictions around the world restrict the beam of a catamaran on a trailer to widths from 8 foot to 8 foot 6 inches. This restriction produces a compulsion to reduce the panel thickness as much as possible to allow the greatest interior room in the restricted trailering width.

If the panels are to be used as simply supported beams like those of Pelly and Francke then thin panels would not be able to be used and a major structure would be needed to brace the centreline hinge from rotating under the mast loading. Obviously thin horizontally rotating panels cannot be used in the typical catamaran method of the simply supported beam. Almost all catamarans use the principle of the simply supported beam to support the mast between the hulls, this is normal catamaran practice. Most large catamarans use a very large simply supported beam, often incorporating the accommodations within in. In small versions where the simply supported beam is an aluminium tube it can be supported by a "dolphin striker", a compression strut and wire arrangement that makes the beam into part of a truss system. The dolphin striker arrangement is commonly used on catamarans up to 18 meters long with tubular beams. These catamarans are usually racing orientated boats and do not have a folding capability. For transport, racing catamarans with aluminium or other beams are usually disassembled. This process can take a full day for a team of sailors when assembling a 40 ft racing catamaran.

Two multihull boat designers, Robin Chamberlin and John Hitch have used a pyramid structure to cope with the mast loads found on catamarans. Chamberlin designed and built "Excess" and Hitch designed and built "Wired". On these examples the mast is stepped on a number of long compression struts, usually 3 a side, that are angled upwards from the hull inner side at angles of approximately 20 degrees and meet under the mast step. The mast compression loading induces a compression force in the tubes that tries to push the hulls apart but this is resisted by stout wires or beams that lock the structure into that of a stressed truss. This arrangement has proven much stiffer than the typical simply supported beam and dolphin striker arrangement and "Excess" was the first catamaran to sail deep into Antarctic waters, proving its structural integrity. This arrangement has many pitfalls. It is very wasteful of deck space, makes crew movement more difficult and is not at all suitable for folding. The compression struts take up interior room in the hulls as the need to be strongly fixed using large bulkheads and frames.

The approach of resolving the major mast loads into compression struts has been proven by the long voyages and structural robustness of the two boats that pioneered the concept. The challenge was to incorporate the lessons from these two boats and make them applicable to a folding mechanism.

When looked at as a whole a major problem with the folding catamaran patents listed above is that they fail to cope adequately with the huge cyclic loadings catamarans can generate whilst being easy and inexpensive to manufacture and promote successful folding and extension. Catamaran beams can rapidly change their loading conditions and in heavy seas the structure can have very high load reversals in a very short period of time. The success of Farrier's patent is due in part to his understanding that loading the connections under one type of load, either tension or compression results in a more stable and effective hull connection for multihulls. His mechanism is structurally sound and easy to use. The structure used in "Excess" and "Wired" is structurally sound and also uses only compression and tension members but is in no way foldable.

By using compression and tension members instead of a simply supported beam for the mast loading a catamaran can be much stiffer than a typical non folding three beamed catamaran. As the mast loading stresses the compression struts (or panels) and the tension members, the whole mast or deck supporting structure becomes locked into position. By making the mast support panels of a reasonable size other load conditions can also be easily dealt with. The hulls are kept parallel to each other, the hulls are kept at the same width and the hull's bows and sterns remain in line with each other. However the tendency of all catamarans to rotate each hull so that the deck rotates inwards, the displacement of each hull vertically and the tendency of a catamaran to rotate one hull relative to the other when lifting a hull is not resisted well.

In the previous uses of the compression strut in catamarans, found in Chamberlin's and Hitch's designs, the struts were buried deep into each hull at various points to resist these other loads. Obviously other ways of resisting these loads have to be found.

By using pivotally interconnected panels which are set in the vertical plane these other load conditions may be coped with properly. Other methods involving sliding tubes and other structures could also be used.

The following mechanism is able to cope with the loads imposed by a catamaran structure with a large safety margin, whilst being easy to use and increasing the catamaran's amenity.

OBJECTS AND ADVANTAGES

Accordingly, besides the objects and advantages of the beam reducing mechanism described in this patent, several objects and advantages are 1. To provide a width reducing mechanism that can adequately cope with all the loads imposed by severe weather conditions.
2. To provide a width reducing mechanism that can easily fold with a mast in the upright position.
3. To provide a width reducing mechanism that is able to be extend or retract on the water.
4. To provide a width reducing mechanism that is quick and easy to operate.
5. To provide a width reducing mechanism that is easy to manufacture.
6. To provide a width reducing mechanism that imparts a high degree of confidence to the user.
7. To provide a width reducing mechanism that is economical to produce.
8. To provide a width reducing mechanism suitable for larger catamarans.
9. To provide a width reducing mechanism that helps increase the amenity of the boat.

Further objects and advantages will become apparent from a consideration of the accompanying description and drawings.

SUMMARY OF THE INVENTION

A multihull boat in which the hulls are able to be laterally extended or retracted on the water with or without a mast. The invention features a catamaran boat with a number of pivotally interconnected panel sets that are orientated in a number of different planes so as to better resist the loads on the catamaran when on the water. The mechanism for expansion and retraction is easy to build, is robust, easy and quick to operate and produces a structure that is stiffer than many non folding catamarans.

DRAWING FIGURES

In the drawings the reference numerals corresponding to a particular object remain the same independent of the view. For example the mast in FIG. 1 is labelled (18). It is labelled (18) in all other drawings.

FIG. 1—This perspective view shows the general arrangement of the beam reducing mechanism along with the mast and rigging wires, the fore and aft beam, and hulls. The upper cabin sides have been removed in this view to better view the mechanism.

Figure 2:
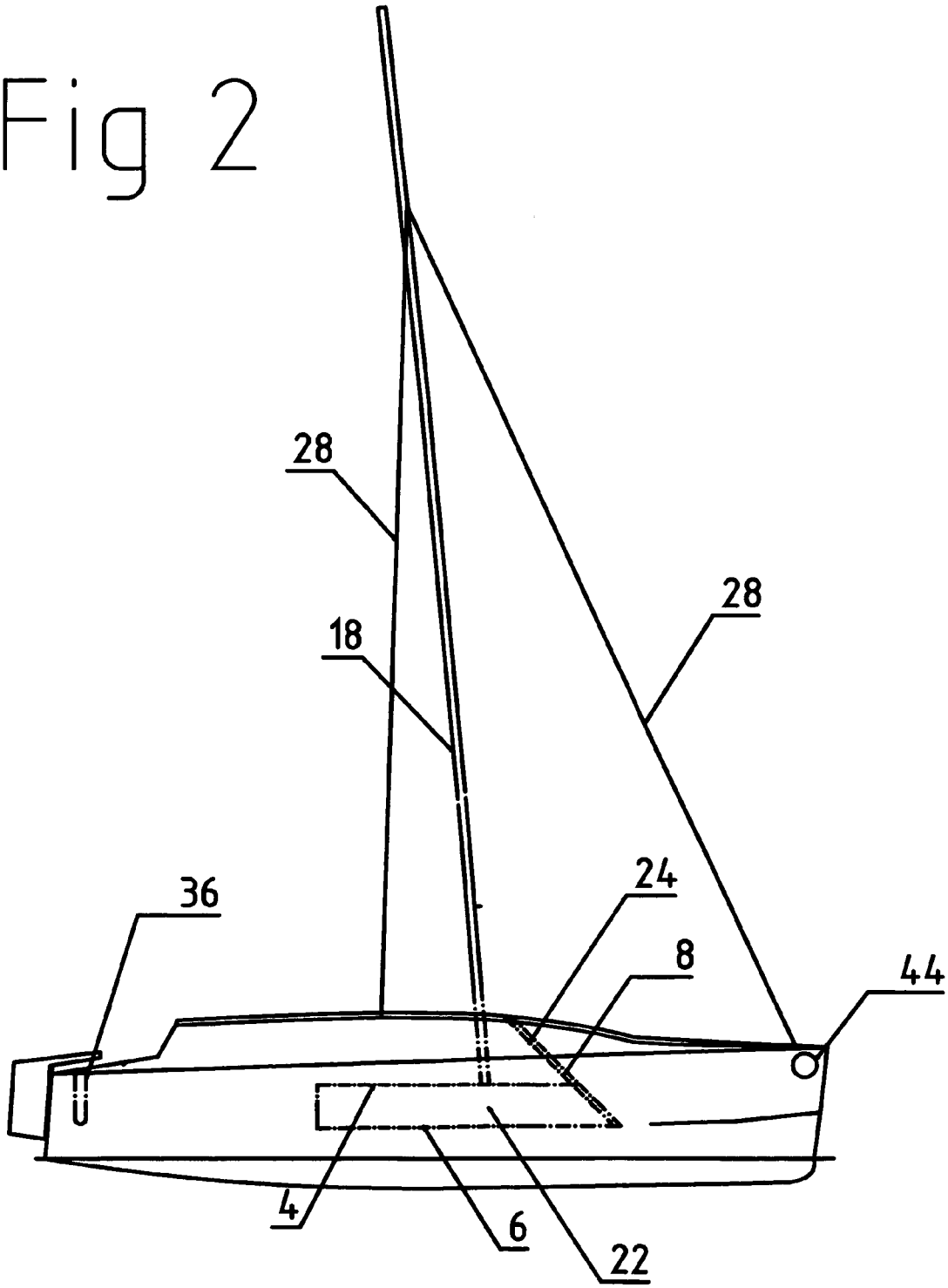

FIG. 2—This right plan view shows the arrangement of the panels when the boat is in the extended configuration. The panels are shown as dashed lines as the right hull hides them.

Figure 3:
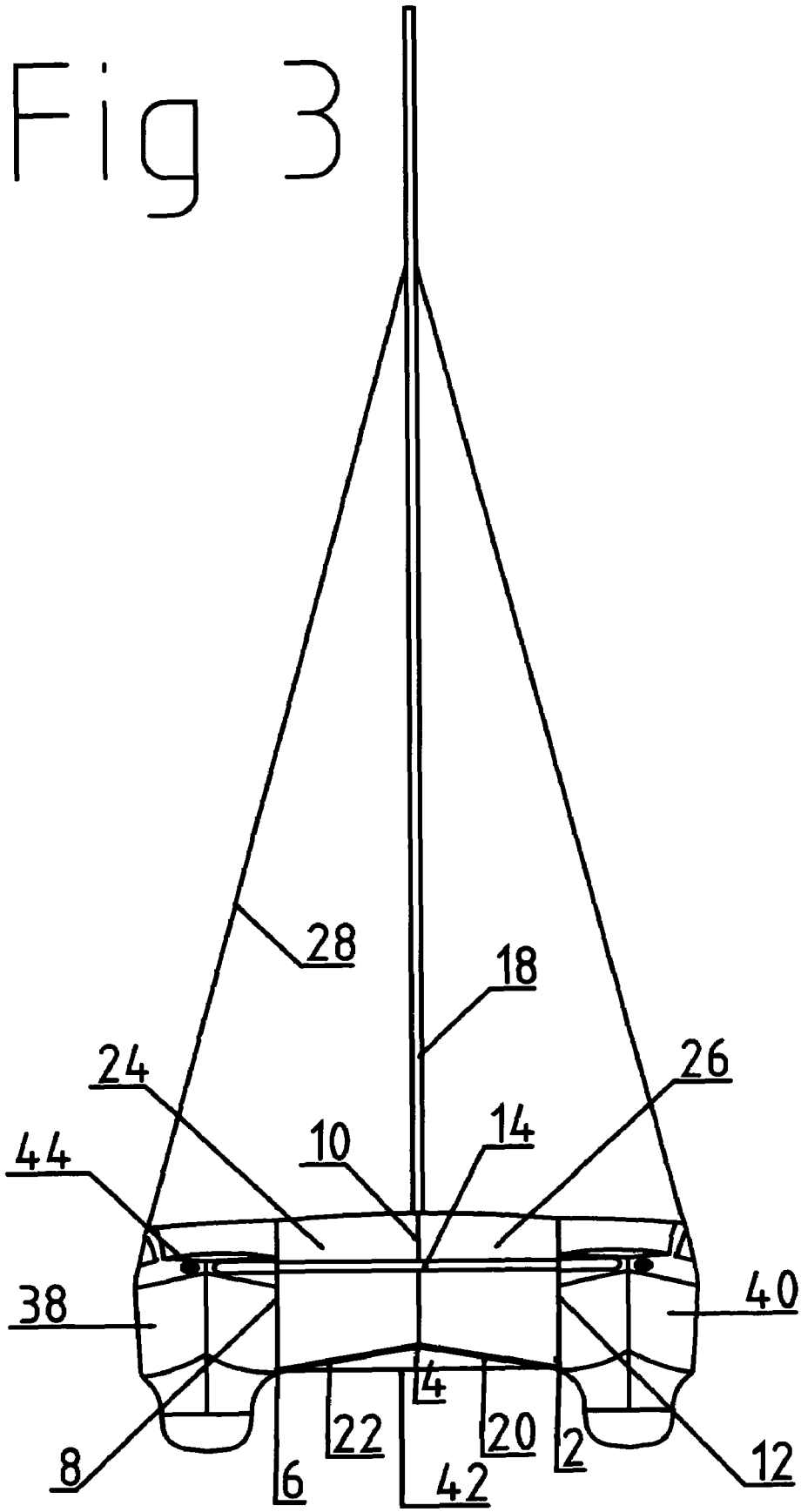

FIG. 3—This front view shows the inverted V of the pivotally interconnected panel set that rotates about a substantially horizontal axis in an extended orientation.

Figure 4:
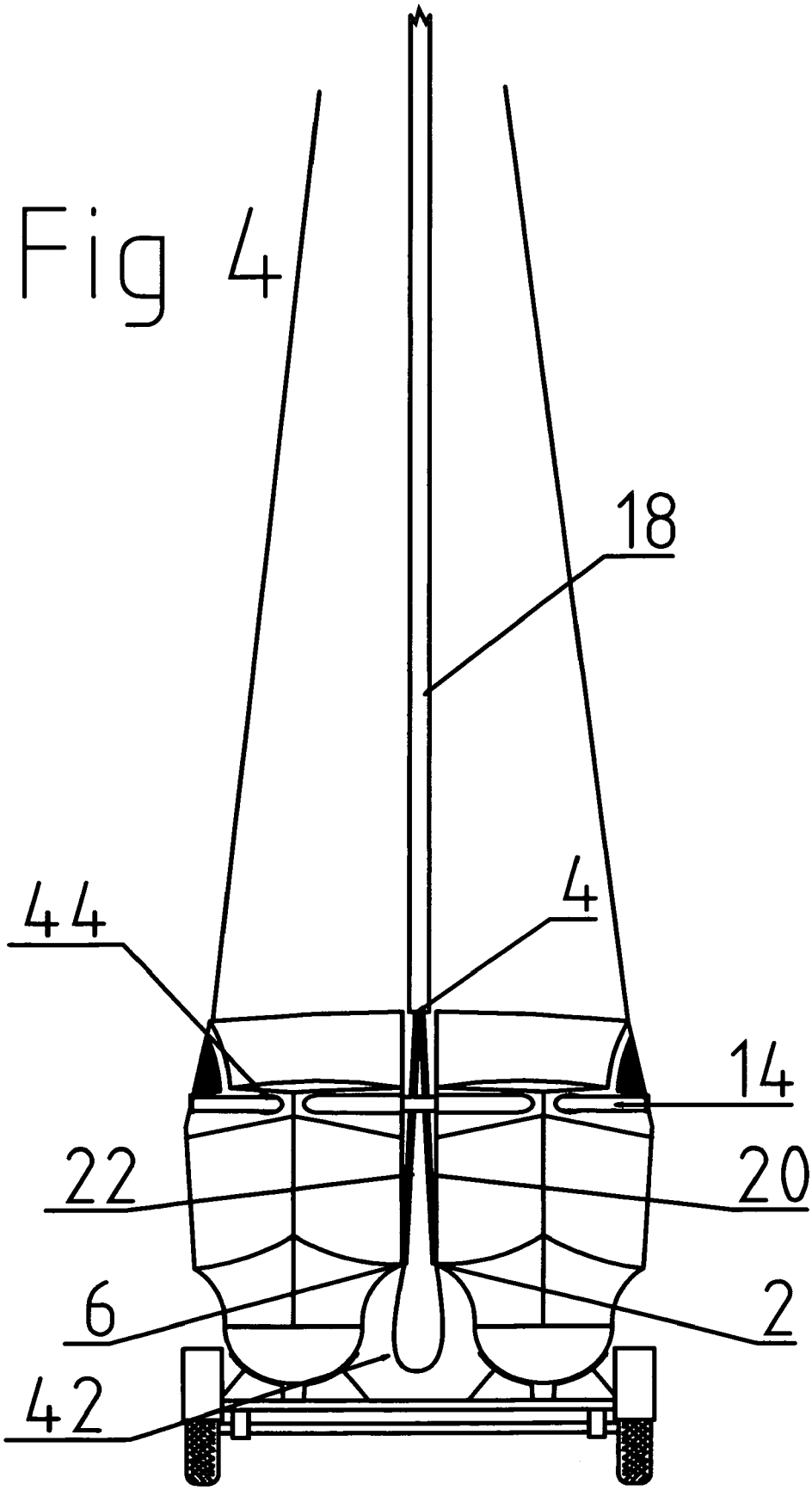

FIG. 4—This front view shows the catamaran on a trailer in its retracted orientation. The panels 24 and 26 have been omitted in this view for clarity.

Figure 5:
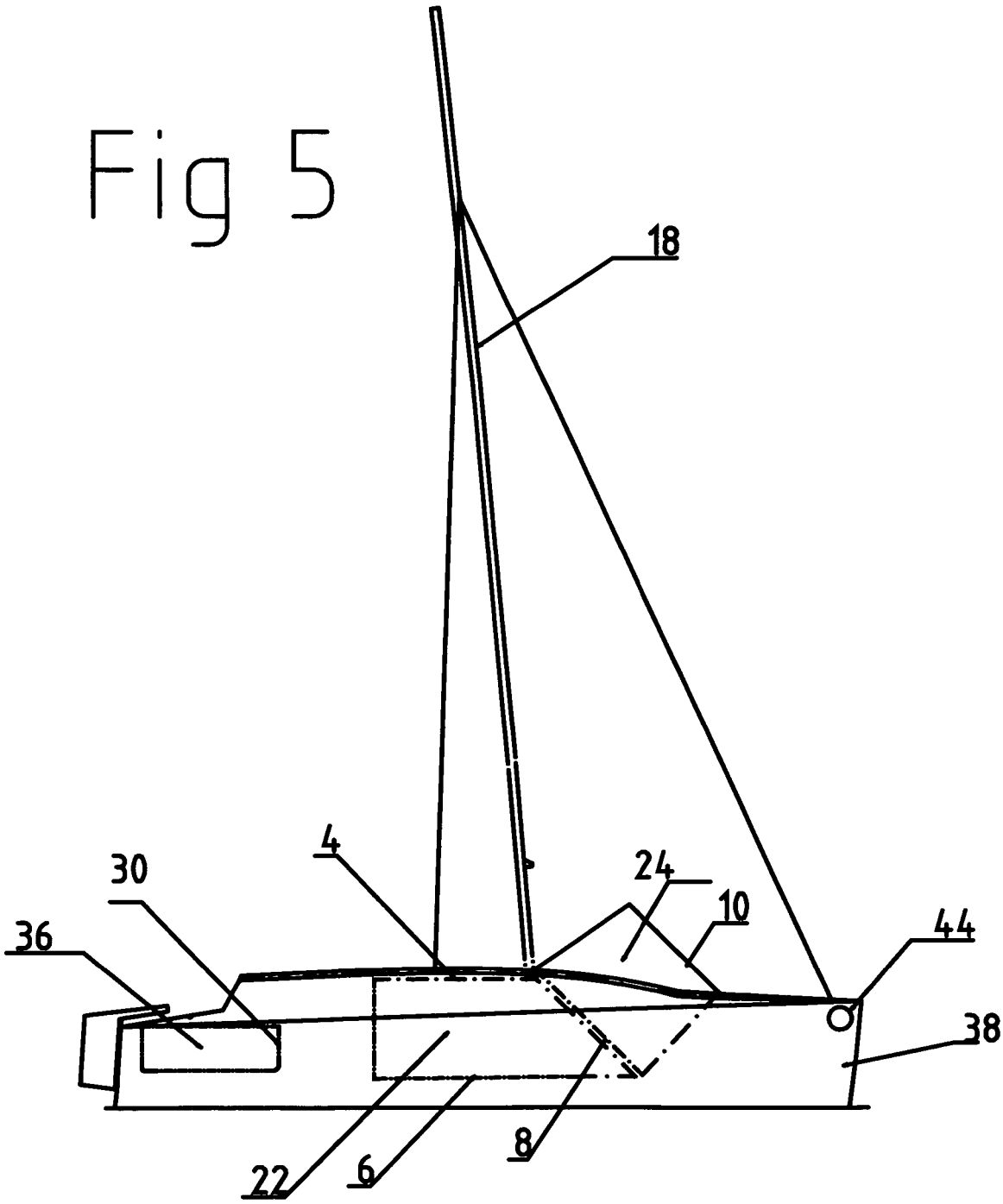

FIG. 5—This right plan view shows the orientation of the panels when the boat is in its retracted orientation.

REFERENCE NUMERALS IN DRAWINGS

2—outer (left) edge of left horizontally rotating pivotally interconnected panel
4—rotation point of horizontally rotating pivotally interconnected panels and denotes inner edge of panels 20 and 22.
6—outer (right) edge of right horizontally rotating pivotally interconnected panel
8—outer (right) edge of right second rotating pivotally interconnected panel
10—rotation point of second rotating pivotally interconnected panels and also denotes inner edge of panels 24 and 26
12—outer (left) edge of left second rotating pivotally interconnected panel
14—forebeam
16—forward edge of horizontally rotating pivotally interconnected panel set
18—mast
20—left panel of horizontally rotating pivotally interconnected panel set
22—right panel of horizontally rotating pivotally interconnected panel set
24—second pivotally interconnected panel set right panel
26—second pivotally interconnected panel left panel
28—rigging wires
30—rotation point of the aft vertical pivotally interconnected panel set and also denotes inner edge of panels 34 and 36
32—outer (left) edge of aft vertical pivotally interconnected panel set
34—left panel of aft vertical pivotally interconnected panel set
36—right panel of aft vertical pivotally interconnected panel set
38—right hull
40—left hull
42—tension member
44—forward beam sleeve

DETAILED DESCRIPTION OF PREFERRED EMBODIMENT

FIG. 1—Folding mechanism arrangement—perspective view from right stern of boat (To better show the folding mechanism arrangement the upper cabin sides of the catamaran are not shown in this view)

FIG. 2—Right elevation of boat in extended configuration

FIG. 3—Front view in extended configuration

FIG. 4—Front view in folded configuration (To better show how the panels fold for beam reduction the second pivotally interconnected panel set has been omitted in this view. Only the pivotally interconnected panel set that rotates about a substantially horizontal axis is shown)

FIG. 5—Right elevation view folded

The folding mechanism shown consists of a number of pivotally interconnected panel sets and a sliding beam. Each pivotally interconnected panel set may consist of a truss, strut, panel, column, board or beam attached to a similar truss, strut, panel, column, board or beam by a hinge or device that allows rotation of the two structures in relation to one another. The sliding beam could consist of a truss, beam, extrusion or other similar structure.

The pivotally interconnected panel sets may also be attached to the catamaran's hulls by a hinge or hinges. Hinges are not integral to the integrity of the mechanism. Any design that allows rotation of the pivotally interconnected panel sets may be used.

The pivotally interconnected panel set that rotates about a substantially horizontal axis (20,22) may be attached at or near its outer edges (2,6) to the catamaran's hulls (38,40) by a hinge, hinges or other method of rotation. Each panel that forms part of the said pivotally interconnected panel set may be joined to another panel by a hinge, hinges or rotation member at or near to their inner edges (4). When fully extended the panels (20,22) that form part of the pivotally interconnected panel set that rotates about a substantially horizontal axis remain at an inverted V configuration (when viewed from in front or behind the catamaran) (FIG. 3) so that the plane in which the center hinge system is located (4) is vertically above the plane of the outer edges (2,6) of the pivotally interconnected panels. This is the preferred embodiment of this arrangement due to a multitude of factors including structural integrity, ease of building, ease of folding and retaining enough height above the water for the deck or nets used by the crew.

In an alternative arrangement the mast or deck supporting pivotally interconnected panel sets that rotate substantially in the horizontal plane (20,22) could be orientated so that the inner edge (4) of each panel (20 and 22) and the centerline (4) of the pivotally interconnected panel set lies upon the plane described by the outer edges of the panels (2,6) and supported with a compression strut and wire brace arrangement. In this case the panels would still be functioning as a compression struts due to the compression introduced by the wire of the strut and wire arrangement. This embodiment would suffer from many structural and design problems.

Another alternative embodiment is one in which the mast or deck support structure (20,22) is allowed to rotate under load until the inner edges (4) of the panels are vertically below the plane of the outer edges of the panels (2,6). The pivotally interconnected panel set (20,22) would not act as compression struts but as tension members due to mast or deck loads in this embodiment. In this alternative embodiment the structure would be much weaker, the structure much more liable to wave attack, the other pivotally connected panel sets (24,26) and (34,36) much more heavily loaded and the catamaran much more prone to accidental folding during use. If panels that rotate about an axis that is substantially horizontal are to provide mast and deck support for seaworthy craft then the preferred embodiment as shown in the diagrams should be followed.

In a sailing boat the mast may be stepped on the inner panel edge (4) of the panels (20,22) as the said edge may be along the catamaran's centreline.

Another set of pivotally interconnecting panels (24,26) may be arranged such that the angle of the axis of rotation is at more vertical angle (See FIG. 2) to the pivotally interconnected panel set that rotates about a substantially horizontal axis (20,22) when looked at in a plan view. This second pivotally interconnected panel set (24,26) may be similar to the pivotally interconnected panel set (20,22) that rotates about a substantially horizontal axis, consisting of a set of panels (24,26) with a (10) central hinge, hinges or rotation method and where the said panels are attached to the hulls at or near to their outer edges (8,12) so that they may rotate about these edges. This second pivotally interconnected panel set may be configured so that when fully extended it touches the pivotally interconnected panel set that rotates about a substantially horizontal axis set along the horizontally orientated pivotally interconnected panel set's forward edge and a strut, connector, wedge, pin, bolt or other attachment may be used to connect the two pivotally interconnected panel sets. (FIG. 1)

The right hand panel of the pivotally interconnected panel set that rotates about a substantially horizontal axis (22) rotates along the right hand hull (38) at (6). This panel (22) may be attached to the left-hand panel (20) of the pivotally interconnected panel set that rotates about a substantially horizontal plane and rotates along or near to edge (4). This left panel (20) rotates along the left hand hull (40) at (2). The second pivotally interconnected panel set (24) is attached to the right hand hull (38) and rotates along or near edge (8). It is joined to its partner (26) along its inner edge (10) which is attached to the left hull (40) and rotates about the hull along its outer edge (2).

When rigged as a sailing boat the mast (18) will push down on the pivotally interconnected panel set (20,22) it rests upon. The collective tension of the supporting stays (28) provide a considerable pull downwards. Due to the inverted V configuration of the pivotally interconnected panel set that rotates about a substantially horizontal axis (20,22) this force is translated into a force that acts along the line of the panels that make up the pivotally interconnected panel set that rotates about a substantially horizontal plane (20,22). This force acts to push the hulls (38,40) laterally apart. This force can be resisted by tension members such as the forebeam (14) of the catamaran and/or a wire or rope (34) and also could be resisted by other pivotally interconnected panel sets. Many other tension member arrangements could be used including chain, folding or sliding extrusions, telescopic tubes and others. More pivotally interconnected panel sets could easily be introduced into the mechanism and the second pivotally interconnected panel set could be removed with modifications to other structural members and/or additions of new members.

The inverted V shape of the pivotally interconnected panel set that rotates about a substantially horizontal axis (20,22) and forms part of the mast or deck support structure is shown in FIG. 3 which shows the laterally extended configuration of the boat. The under wire (42) that helps limit the lateral extension of the two hulls (38,34) is also clearly shown in this view. In an alternative embodiment the secondary pivotally interconnected panel set may also have a similar inverted vee orientation but in the preferred embodiment the second pivotally interconnected panel set is substantially planar when in its extended orientation.

To reduce beam the hulls (38,40) are brought together using a tackle or winch arrangement and each panel of the pivotally interconnected panel sets rotates about its outer edge in relation to the hull and about its common rotation point with its mirrored partner. This makes the centre common edges (4) of the pivotally interconnected panels set (20, 22) move upwards as shown in FIG. 4 and FIG. 5. The same movement occurs in the second panel set (26,24). This pivotally connected panel set's common hinge point (10) has moved perpendicularly to the plane of the panel's outer edges (12,8). The aft pivotally connected panel set (34,36) also moves its common rotation (30) in a direction perpendicular to the plane of its outer edges. The mast (18) is lifted vertically upwards at its base when the hulls are laterally retracted (FIG. 4). This allows for easy mast lowering or raising when the boat is in its trailerable configuration. Special extension tackles are needed to allow the mast stays (28) to lengthen as the mast (18) base moves upwards. These tackles can take the form of a rope that runs through a pulley near the stay (28) attachment and then down to close to the inside edge (4) of panels (20,22).

The pivotally interconnected panel sets (22,20), (24,26) and (34,36) rotate around their respective hinge or rotation arrangements about their outer and common edges during lateral extension and retraction. The angle between the two panels in each pivotally interconnected panel set reduces as lateral hull retraction takes place. The forebeam (14) slides in its sleeve (44) allowing beam reduction. When fully retracted the forebeam may extend beyond the sleeves (44) in which the forebeam (14) slides. It could also be mounted on deck and slide through a collar or other similar arrangement. The forebeam and/or aft beam may be omitted and the mechanism may still be functional as long as some means of limiting extension of the pivotally interconnected panel sets is provided. However omitting the forebeam may prove problematic as the forebeam provides structural integrity to the catamaran when the catamaran is undergoing folding and when fully folded. To this end the forebeam may use rollers or roller bearing systems to reduce friction when folding. This could also be achieved by other methods as stated before and is not pivotal to this patents novelty.

The tension wire or rope (42) becomes slack or can indeed be used to provide the force required for beam reduction during the retraction process.

Operation

When the catamaran is in its extended configuration (FIGS. 1, 2 and 3) the rigging (28) must be somewhat tight. This applies a downward force on to the pivotally interconnected panel set that rotates about a substantially horizontal axis (20,22). The forces in the panels have a large horizontal component that pushes the two hulls (38,40) apart.

The hulls are limited in the amount that they can be pushed apart. This can be achieved by a limiting flange on the forebeam (14) by tension in the pivotally interconnected panel sets that are substantially planar (24,26 and 34,36) and/or by the inclusion of a tension member (42). The arrangement of the pivotally interconnected panel set (20,22) (which is in compression) and tension member(s), forebeam and aft beam lock the hulls into a definite and stable geometry.

The manner of using the width reducing mechanism is as follows.

Retraction—Reduction of Width

The panel geometry is such that the catamaran cannot reduce its extended width unless the rigging (28) is loosened. This is a safety feature. A connecting tie, bolt or pin between the pivotally interconnected panel set that rotates about a substantially horizontal axis (20,22) and the second pivotally interconnected panel set (24,26) also stops retraction and must be loosened or removed for retraction. Other safety features may include the provision of bolts, pins, clips or wedges in the forebeam (14) and in the aft pivotally interconnecting panel set (34,36) and the provision of solid floors which must be lifted to laterally retract the hulls. Collectively and individually, these safety features help stop inadvertent retraction if the mast is lost, is not raised, or the boat is configured for use as a powerboat. Once the rigging (28) is loosened, the connecting tie, bolts or pins removed, the forebeam (14) and aft pivotally interconnected panel set are unrestrained and the decks lifted, retraction can occur.

This mechanism can be used when the hulls are free to move sideways. It is designed to be easily used when on the water. However it is possible to provide a trailer, trolley arrangement or skid to effect this change in width on land. On small catamarans the tension member (42) or another line is pulled by hand. On larger catamarans a line or chain could be led to a winch and winched on. Another arrangement could entail the use of hydraulics to the same effect.

Extension—Increase in Width

After the catamaran is fully retracted it should be in the orientation shown in FIG. 4. To extend the catamaran's width the hulls can be pushed apart by hand, or as has proved most effective a line arrangement using the forebeam can be used and/or, hydraulics or other mechanical means can be used.

When the catamaran is fully extended the rigging (if mast is used) is tightened. The forebeam (14) can restrained with bolts, pins, clips or wedges and the line used to pull the hulls together can be cleated off. The pivotally interconnected panel set that rotates about a substantially horizontal axis (20,22) and the second pivotally interconnected panel set can be connected by bolts, pins or a tie member.

In its normal configuration the catamaran may also have solid floors that hinge down or are inserted after extension. These solid floors also stop inadvertent retraction unless they are lifted up so that the aft beam can fold forward and the hulls can move towards each other.

SUMMARY, RAMIFICATIONS AND SCOPE

Accordingly the reader will see that the inverted V pivotally connected panel set folding mechanism can be used to reduce the beam of a catamaran easily and conveniently. In addition the mechanism provides added amenity to the crew as the pivotally interconnected panel sets can be orientated to form a floor and also a windbreak for the crew in the cockpit. Furthermore the inverted V panel pair folding mechanism has additional advantages in that

- The folding mechanism can be easily produced using flat panels, metal trusses, struts or other load bearing configurations
- The catamaran does not require a special trailer to assist in beam reduction.
- The mast can be raised and lowered with the boat in a retracted or extended configuration
- The catamaran can undergo beam retraction or extension when stopped or under way.
- The catamaran can undergo beam retraction or extension on the water
- The catamaran cannot be retracted inadvertently with the mast raised and rigging tight.
- The mast is not integral to the mechanism
- The hull shape required for the folding mechanism is consistent with current accepted design practice
- The folding mechanism can be used on power catamarans
- The catamaran can be moored in its folded state in a marina berth Although the description above contains many specificities, these should not be construed as limiting the scope of the invention but as merely providing illustrations of some of the presently preferred embodiments of this invention. For example the mechanism can have one or more pivotally interconnected panel sets, a central member could be installed between the panel pairs making the pivotally interconnected panel set mechanism a three-part arrangement. The angle of the inverted V of the pivotally interconnected panel set that rotates about a substantially horizontal axis can also be altered as can angles between the pivotally interconnected panel sets.

Importantly the panel shape or construction should not be seen as integral to the invention as the flat panels could be replaced by a number of different arrangements such as trusses, extrusions of many shapes, and other arrangements.

I claim:

1. A catamaran sailboat that is comprised of two hulls, each of said hulls having a buoyancy section, a deck that is located upon said hulls, and a plurality of pivotally interconnected panel sets including a subset of pivotally interconnected panel sets that support a mast and rigging loads of said sailboat, where the pivotally interconnected panels of at least one of the said panel sets that support the mast and rigging loads are arranged so that their inner edges are located above a plane on which outer edges of said panel sets lie, and where a pivotally interconnecting panel set consisting of two rotating compression struts that rotate about their respective outer edges are joined along their inner edges substantially close to a centerline of said sailboat, and where an innermost edge of each pivotally interconnected panel is located above a plane of the outer edges of said panels in both a laterally extended position and a laterally retracted position of said sailboat.

2. The catamaran sailboat of claim 1, where each panel of said pivotally interconnected panel set rotates about its outer edges as the hulls of said sailboat are shifted between said laterally extended and retracted positions.

3. The catamaran sailboat of claim 2, where lateral extension or retraction of the hulls of said sailboat causes the rotation of said pivotally interconnected panel sets about their edges without causing a substantial change in vertical orientation of said hulls.

4. The catamaran sailboat of claim 1, where each pivotally interconnected panel set may include a hinging or rotation device at the outer edge of a left hand panel attaching said left hand panel to a left hand hull of said sailboat, the said left hand panel, a hinging or rotation device attached to the inside edge of said left hand panel which also attaches to a right hand panel, the said right hand panel and a hinging or rotation device attaching said right hand panel to a right hand hull of said sailboat.

* * * * *